United States Patent [19]

Sato et al.

[11] 4,418,876

[45] Dec. 6, 1983

[54] METHOD OF WINDING A STRAND OF RELATIVELY RIGID GLASS FIBER ONTO A ROTATING STRAND WINDING SLEEVE

[75] Inventors: Michio Sato; Shin Kasai; Yutaka Kawaguchi, all of Fukushima, Japan

[73] Assignee: Nitto Boseki Co., Ltd., Fukushima, Japan

[21] Appl. No.: 259,689

[22] Filed: May 1, 1981

Related U.S. Application Data

[60] Division of Ser. No. 96,121, Nov. 20, 1979, abandoned, which is a continuation-in-part of Ser. No. 919,647, Jun. 28, 1978, abandoned.

[30] Foreign Application Priority Data

Jun. 28, 1977 [JP] Japan ..... 52-85629

[51] Int. Cl.[3] ..... B65H 54/02

[52] U.S. Cl. ..... 242/18 G; 242/18 PW; 242/46.2; 242/46.5

[58] Field of Search ..... 242/18 G, 18 PW, 18 R, 242/46.2, 46.3, 46.4, 46.5, 46.6

[56] References Cited

U.S. PATENT DOCUMENTS

| | | | |
|---|---|---|---|
| 3,099,411 | 7/1963 | Geen | 242/46.5 |
| 3,198,445 | 8/1965 | Hull, Jr. et al. | 242/18 PW |
| 3,819,123 | 6/1974 | Luz | 242/18 PW |
| 4,046,329 | 9/1977 | Eisenberg et al. | 242/18 G |

*Primary Examiner*—Stanley N. Gilreath
*Attorney, Agent, or Firm*—Gerald J. Ferguson, Jr.; Joseph J. Baker

[57] ABSTRACT

A glass fiber strand winding apparatus having a primary strand winding portion and a preliminary strand winding portion comprises a flanged portion the diameter of which is greater than that of the preliminary winding portion and at least one groove axially provided in the preliminary winding portion and the flanged portion from the inner end of the preliminary winding portion.

3 Claims, 7 Drawing Figures

METHOD OF WINDING A STRAND OF RELATIVELY RIGID GLASS FIBER ONTO A ROTATING STRAND WINDING SLEEVE

This application is a division of U.S. Application Ser. No. 96,121, filed Nov. 20, 1979 (now abandoned), which, in turn, is a continuation-in-part of U.S. Ser. No. 919,647, filed June 28, 1978 (now abandoned).

BACKGROUND OF THE INVENTION

The present invention relates to an improved winding apparatus wherein a strand made of heat softenable material such as glass fiter is wound thereon after spinning.

Fiber made of heat softenable material such as glass fiber is drawn from a bushing or spinning furnace, is thereafter formed into a strand through a gathering shoe with sizing agents, and is introduced onto an auxiliary or preliminary winding portion of a winding sleeve. The strand is manually wound thereon by utilizing the adhesive force of the sizing agents and the winding tension. Until filament diameters of the strand are attenuated to a desirable extent, the strand is continuously wound on the preliminary winding portion. When the filament diameters of the strand become sufficiently attenuated, the strand is introduced onto a primary winding portion of the winding sleeve.

In glass fiber strand winding, the glass fibers are typically 70–80 microns in diameter and they exit the bushing furnace at a relatively high speed. Several hundred to several thousand glass fibers may be drawn from a single bushing furnace and all of these fibers are wound to constitute a single glass fiber strans. The result is a rigid and thick glass fiber strand of 8,000 to 10,000 TEX. The strand is wound while the fibers are still in a non-dried or wet condition immediately after drawing the fibers from the furnace and, therefore, the strand must be wound on a winding drum having a circumferential speed which is of approximately of the same magnitude as the drawing speed of the fibers from the furnace. This may be approximately 1,000 meters per minute. In addition, the strand is optically coated with sizing agents (binders) which renders these relatively rigid thick fibers extremely difficult to handle and control. All of these various characteristics of glass fiber strand winding present significant problems in the design and operation of a strand winding device.

More specifically, referring to FIGS. 1 and 2, a conventional winding sleeve A is constructed of a primary winding portion B which is engaged with the winding sleeve body, and a preliminary or waste winding portion C having a plain cylindrical surface D continuously connected to the winding portion B. Typically, the winding drum is continuously rotated at a speed of approximately 1,000 meters per minute. While the drum is continuously rotating at such a speed, a strand G' coated with sizing agents is introduced onto the preliminary winding portion D by the operator and is wound on the outer periphery thereof by the manual operation through an angle of more than 270° so that the strand may thereafter be automatically wound on the portion D through strand guiding means H as mentioned above. After the above operation, the end E of the strand is drawn in the direction of arrow F and is cut by the operator. If at the initial stage the winding is deficiently achieved when the drawing force in the direction of the arrow F is actuated there is a possibility that the winding shape G of the strand will be collapsed or deformed so that the strand is drawn and cannot be properly cut. Further, if the thickness of the wound strand is too large, the strand may slip from the winding portion due to the small frictional force between the adjacent strand surfaces. This latter tendency is especially remarkable in the case of a rigid fiber having diameter filaments or if an adhesive or sizing agent having a poor adhesiveness is used. In such cases, a manual winding angle of more than 360° is required before the automatic winding operation onto the preliminary winding portion D. A great skill is required therefor and the fiber is still difficult to work with. Furthermore, the quality of the strand is deteriorated due to the plumes generated with slipping-off of the strand. The generated plumes tend to be in contact or mixed with a strand which is drawn and wound onto the primary winding portion.

Efforts have been made to prevent the strand from slipping off of the strand winding device shown in FIGS. 1 and 2, but these have not proven entirely satisfactory. U.S. Pat. No. 3,099,411 discloses a strand winding device in which the preliminary or waste winding portion is provided with a plurality of V-shaped circumferential grooves. This provides some improvement but is still not satisfactory since the glass fibers quickly fill the grooves and may then slip over one another. Further, there is still a possibility that the preliminary winding portion may be caused to unravel when the initially wound end E is pulled in the axial direction so that it may be cut.

SUMMARY OF THE INVENTION

It is an object of this invention to prevent the non-dried or wet, glass fiber wound on an auxiliary winding portion of the winding device from slipping off and from deforming its winding shape.

Briefly, in order to overcome the above defects inherent to the conventional strand winding apparatus, the invention provides an improved winding apparatus in which the preliminary winding portion of the winding device is provided with an end flange for preventing the wound strand from slipping off when the end of the strand is pulled in the axial or central direction for the cutting operation. At least one axial groove is provided in the preliminary winding portion and flange to increase the winding friction thereon and to provide an abutment surface past which the strand end may be axially pulled while substantially eliminating the axial pulling force on the remaining wound strand.

DETAILED DESCRIPTION OF THE INVENTION

Figure 2:
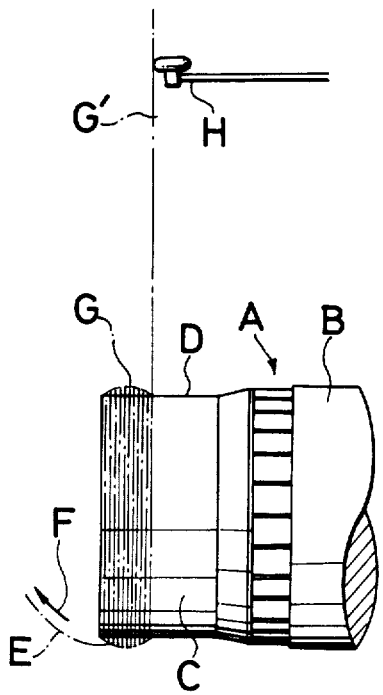
FIG.2 PRIOR ART
FIG. 2 shows a front view of the primary part of the winding apparatus of FIG. 1.
Figure 1:
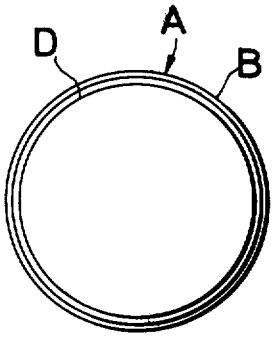
FIG.1 PRIOR ART
FIG. 1 shows a side view of the conventional winding apparatus.

Referring to the accompanying drawings, the present invention will be hereinafter described. FIGS. 3 to 6 show a preferred embodiment of the invention. A strand winding sleeve 1 is constructed of a primary strand winding portion 2 and a preliminary winding portion 3, both of which are integral with a conical portion 4. The preliminary winding portion 3 has a plain cylindrical surface and a flanged portion 6 integral therewith. The diameter of the flanged portion 6 is greater than that of the preliminary winding portion 3 and smaller than that of the primary winding portion 2.

At least one groove 8 is formed in the flanged portion 6 and in the preliminary winding portion 3 in the axial direction of the winding sleeve. Of course, the level of the bottom of the groove 8 is lower than the surface of the preliminary winding portion 3 with respect to the axis of the winding sleeve. In the specific embodiment shown in FIGS. 3 to 6, four grooves are provided therein. Each angle or ridges 9 and 10 are preferably 90° in view of the strand cutting operation. That is, at the ridge 9 the surface of the preliminary winding portion 3 meets the inner surface of the flange 6 and the inner surface of the groove 8 at 90° angles. Similarly the inner surface of groove 8 and the outer end surface of the flange 6 meet at the ridge 10 with an angle of 90°.

In this embodiment, an end 11 of the strand 12 is led to the rotating preliminary winding portion 3 and is wound thereon by an angle about 270° by the manual operation of the operator. Since in each portion of the grooves 8 the strand is slightly varied from part of circle to a straight line, the frictional force generated between the circumferential surface of the preliminary winding portion 3 and the strand is increased to thereby positively achieve the strand winding operation onto the preliminary winding portion 3 even in the case of large rigid strands with sizing agents. During the forming of a winding layer 13 of the strand 12 on the preliminary winding portion, if the end 11 of the strand 12 is drawn to the center as in the direction of arrow P, the end 11 slips over the circumferential surface of the flanged portion 6 to the next adjacent groove 8 where it will fall into the groove in abutment with the ridges 9 and 10 to be cut. Since the axial force on the strand end 11 is supported by the abutment surface 10, there is no axial force applied to the remainder of the strand 13 wound on waste winding portion and, consequently, there is no danger of unraveling or otherwise disrupting the portion 13. The length of the groove 8 may be shorter than that shown in FIGS. 4 and 6. That is, the length of the groove 8 may be a length from the end of the sleeve 1 to the middle of the preliminary winding portion 3.

In many cases, a significant amount of strand must be wound on the preliminary winding portion before the diameter of the strand is sufficiently attenuated. However, even if the amount of the wound strand is increased to such an extent that the laver 13 wound on the waste strand winding portion 3 becomes very large, and even if the strand is quite rigid and is very slippery due to the use of sizing agents so that they strands are liable to slip between one another when the strand end is pulled in the axial direction, the unraveling of the wound strand 13 or the disruption of that portion will be prevented due to the presence of the flange portion 6 which has a diameter greater than the diameter of the preliminary winding portion 3.

As the winding layer of the strand on the preliminary portion is formed, the filament diameters of the strand become desirable values and then the strand is led to the primary winding portion by a conventional leading device (not shown).

Figure 7:
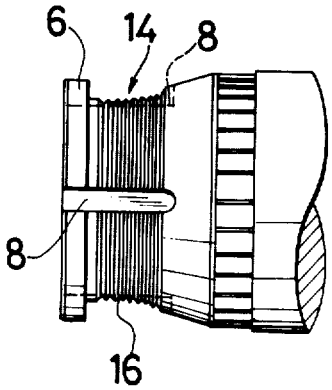
FIG. 7 shows a front view of another embodiment of the invention.
Figure 3:
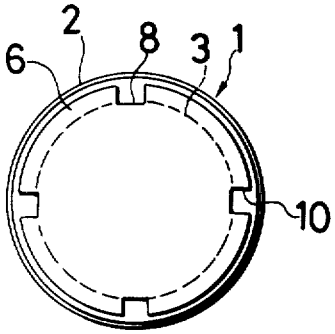
FIG. 3 shows a side view of the winding apparatus according to the present invention.
Figure 4:
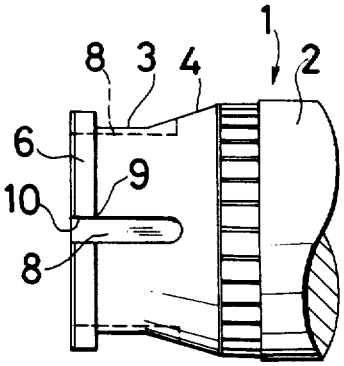
FIG. 4 shows a front view of the primary part of the winding apparatus of FIG. 3.
Figure 5:
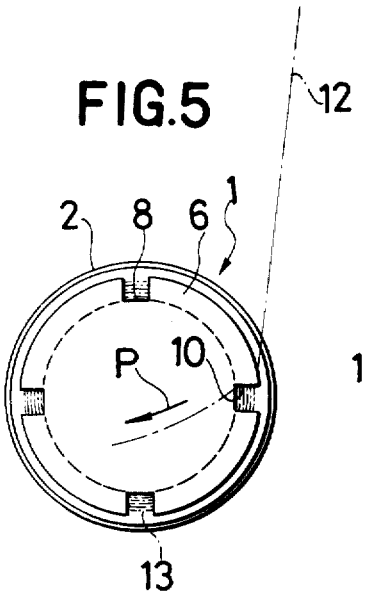
FIG. 5 shows a side view of the winding apparatus in the strand winding state according to the invention.
Figure 6:
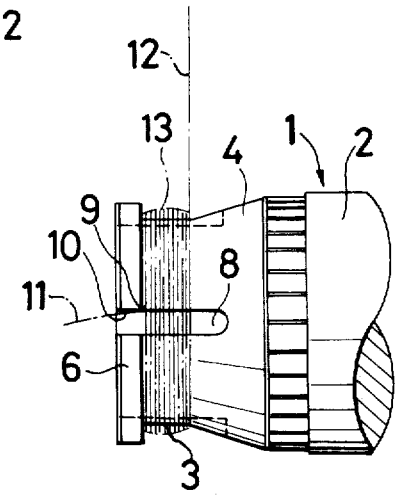
FIG. 6 shows a front view of the primary part of FIG. 5.

FIG. 7 shows another embodiment of the invention. The embodiment is mainly similar to the embodiment shown in FIGS. 3 to 6 and only the difference therebetween will be described. In the embodiment shown in FIG. 7, the shape of a preliminary winding portion 14 is conical or a body revolution having a smooth or gentle slope and, further, a plurality of V-shaped grooves 16 are formed therein in the circumferential direction to further prevent axial slippage of the wound strands. The strand is dropped down near the bottom of the V-shaped grooves 16 by the winding tension, increasing the contracting surface therebetween. The frictional force generated therebetween is enhanced. The V-shaped grooves may be spiral and otherwise in the form of a plurality of parallel lines with the flange 6.

In both of the embodiments, removal of the winding layer of the strand is easily carried out by inserting a knife or the like into the groove 8.

What is claimed is:

1. A method of winding a strand of relatively rigid glass fiber having large diameter filaments onto a rotating strand winding sleeve including a primary strand winding portion and a preliminary strand winding portion where the preliminary strand winding portion has (a) a flanged portion formed on the outer peripheral end surface thereof having a diameter which is greater than that of the preliminary winding portion, (b) at least one first groove axially provided therein, and (c) at least one second groove axially provided in the flanged portion, said first and second grooves being continuous and formed in a straight line and extending radially inward of the surface of said preliminary winding portion, said method comprising the steps of winding the strand of relatively rigid glass fiber onto the preliminary winding portion so that the strand is slightly deformed from an arc to a straight line as it passes over said first groove to thereby enhance the frictional force between edge corners of the first groove and the wound strand, axially pulling the first portion of the strand wound on the preliminary winding portion through the second groove in the flanged portion to effect cutting and removal thereof by one of the edge corners of the second groove, leading the strand to the primary strand winding portion;

winding the strand onto said primary strand winding portion; and inserting a knife into said first groove to cut the strand wound on the preliminary winding portion.

2. A method as in claim 1 wherein said cutting and removal of the first portion of the strand occurring prior to the winding of the fiber onto the primary winding portion.

3. A method as in claim 1 wherein said cutting and removal of the first portion of the strand occurring shortly after commencement of winding of the glass fiber on the preliminary winding portion.

* * * * *